US008517764B2

(12) United States Patent
Wei et al.

(10) Patent No.: US 8,517,764 B2
(45) Date of Patent: Aug. 27, 2013

(54) COAXIAL CABLE CONNECTOR HAVING A BARREL TO DEFORM A PORTION OF A CASING FOR CRIMPING A COAXIAL CABLE

(75) Inventors: Kai-Chih Wei, Taipei (TW); Ming-Feng Chien, New Taipei (TW); Michael Holland, Santa Barbara, CA (US)

(73) Assignee: Ezconn Corporation, Taipei (TW)

( * ) Notice: Subject to any disclaimer, the term of this patent is extended or adjusted under 35 U.S.C. 154(b) by 51 days.

(21) Appl. No.: 13/334,209

(22) Filed: Dec. 22, 2011

(65) Prior Publication Data

US 2013/0130545 A1 May 23, 2013

Related U.S. Application Data

(63) Continuation-in-part of application No. 13/303,239, filed on Nov. 23, 2011.

(51) Int. Cl.
*H01R 9/05* (2006.01)

(52) U.S. Cl.
USPC ..... 439/578

(58) Field of Classification Search
USPC ..... 439/578–585
See application file for complete search history.

(56) References Cited

U.S. PATENT DOCUMENTS

| | | | | |
|---|---|---|---|---|
| 7,252,546 | B1 * | 8/2007 | Holland | 439/584 |
| 7,364,462 | B2 * | 4/2008 | Holland | 439/584 |
| 8,113,879 | B1 * | 2/2012 | Zraik | 439/584 |
| 2003/0025283 | A2 * | 2/2003 | Montena | 280/1 |
| 2005/0260890 | A1 * | 11/2005 | Holland | 439/578 |
| 2006/0128217 | A1 * | 6/2006 | Burris | 439/584 |

* cited by examiner

*Primary Examiner* — Chandrika Prasad
(74) *Attorney, Agent, or Firm* — Bacon & Thomas, PLLC

(57) ABSTRACT

An electrical connector for use with coaxial cables includes deformable cylindrical casing and a slidably engaged barrel.

23 Claims, 15 Drawing Sheets

COAXIAL CABLE CONNECTOR HAVING A BARREL TO DEFORM A PORTION OF A CASING FOR CRIMPING A COAXIAL CABLE

This application is a Continuation-In-Part of application Ser. No. 13/303,239, filed on Nov. 23, 2011, now pending. The patent application identified above is incorporated here by reference in its entirety to provide continuity of disclosure.

BACKGROUND OF THE INVENTION

1. Field of the Invention

The present invention relates to items of manufacture. More particularly, the present invention relates to a signal connector useful for, among other things, terminating a signal cable.

2. Description of the Related Art

Following fast development of electronic and multimedia technology, advanced TV, audio system, video player, digital camera, video game machine and may other electronic products have been continuously created to serve people. Due to critical requirements from consumers, signal transmission requires high stability and rapid speed. To achieve high performance, high quality audio and video equipment must be used with high quality signal lines and signal connectors.

Subject to the application of telephone technology, video technology and internet technology, global communication becomes faster and cheaper. Transmission of video signal through a cable assures signal stability and reliability. Therefore, CATV (closed-circuit TV) is developed after the application of wireless TV and satellite TV. A CATV is adapted for providing television programs to consumers via RF signals transmitted to televisions through coaxial cables or digital light pulses through fixed optical fibers located on the subscriber's unit. Establishing a closed-circuit television system requires installation of cables between the provider and the subscribers. When a cable is extended to a house, an electrical signal connector is commonly used to connect the cable to an indoor electric or electronic device. During installation, the size, specification and impedance (for example, 75 Ohm) of the connector are substantially matched with the cable characteristics. After insertion of the cable into the connector, a compression tool provides a 360 degree connection. In various embodiments, the compression connection enhances connection stability and protects the connection against external water or impurities.

FIGS. 11 and 12 illustrate a known electrical signal connector A. As illustrated, the electrical signal connector A comprises a locknut A1, an outer tubular member A3 connected to the locknut A, an inner tubular member A2 mounted in the outer tubular member A3, and an end-cap A4 slidably engaging a first end of outer tubular member A3. During installation, the center conductor B1, inner dielectric insulator B2 and aluminum foil shield B3 of the coaxial cable B are inserted into the outer tubular member A3 and then into the axial hole A20 of the inner tubular member A2 to have the braided metal wrapper (woven copper shield) B4 and outer plastic sheath B5 of the coaxial cable B be sleeved onto the inner tubular member A2 within the outer tubular member A3, and then a crimping tool is operated to move the end-cap A4 relative to the outer tubular member A3 and toward a second end of the outer tubular member opposite its first end and to compress outer tubular member A3 and to force a barbed portion A31 of the outer tubular member A3 into engagement with the braided metal wrapper (woven metal shield) B4 and outer plastic sheath B5 of the coaxial cable B against the inner tubular member A2. Thus, the electrical signal connector A and the coaxial cable B are fixedly fastened together. According to this design, the end-cap A4 has simply a part of the inner wall kept in contact with the outer tubular member A3. When moving the end-cap A4 relative to the outer tubular member A3, the outer tubular member A3 may be biased relative to the coaxial cable B, and the barbed portion A31 of the outer tubular member A3 may be not positively forced into engagement with the braided metal wrapper (woven metal shield) B4 and outer plastic sheath B5 of the coaxial cable B against the inner tubular member A2.

Further, it is necessary to insert the coaxial cable B through the end-cap A4 before inserting the coaxial cable B into the axial hole A20 of the inner tubular member A2. After insertion of the center conductor B1, inner dielectric insulator B2 and aluminum foil shield B3 of the coaxial cable B into the axial hole A20 of the inner tubular member A2, the end-cap A4 can then be moved relative to the outer tubular member A3 to compress outer tubular member A3 and to force a barbed portion A31 of the outer tubular member A3 into engagement with the braided metal wrapper (woven copper shield) B4 and outer plastic sheath B5 of the coaxial cable B against the inner tubular member A2. This installation procedure is complicated, requiring much effort. Further, if the outer tubular member A3 is biased relative to the coaxial cable B and the barbed portion A31 of the outer tubular member A3 is not positively forced into engagement with the braided metal wrapper (woven copper shield) B4 and outer plastic sheath B5 of the coaxial cable B against the inner tubular member A2, the signal transmission quality will be adversely affected.

Therefore, it is desirable to provide an electrical signal connector, which eliminates one or more of the aforesaid drawbacks and facilitates quick and accurate installation, assuring a high level of signal transmission quality.

SUMMARY OF THE INVENTION

An electrical signal connector for use with coaxial cables includes a deformable cylindrical casing and a slidably engaged barrel. In various embodiments the connector provides improvements including one or more of simple operation, a length conserving configuration, no plug or cap that is mounted to a cable entry end of a cylindrical casing, a single compression tool for compression irrespective of the connector type (F-type, BNC, RCA, . . . etc.), and no need to mount the compression tool at the cable entry end of the connector.

In an embodiment, a cylindrical casing has a first end for receiving a coaxial cable and a second end for receiving a core tube; the core tube engages a first fastener operable to fasten the connector to a mating second fastener; in a first configuration, the cylindrical casing extends through a barrel having first and second open ends; the cylindrical casing and the barrel are dimensioned such that the barrel is operative to radially compress and radially deform the cylindrical casing when the barrel is moved from its position in the first configuration toward the cylindrical casing first end; and, the deformation is operative to pinch portions of a coaxial cable located between the cylindrical casing and the core tube.

In another embodiment, a cylindrical casing has a first end for receiving a coaxial cable and a second end for receiving a core tube; the core tube is coupled to a fastener; a barrel is located in an initial position between the first and second ends of the cylindrical casing; the barrel slidably engages the cylindrical casing; movement of the barrel from the initial position toward the cylindrical casing first end radially compresses a deformable portion of the cylindrical casing including a tapered abutment face; and, the deformation is operative to fix portions of a coaxial cable passing between the cylindrical casing and the core tube.

In yet another embodiment, a method of making a coaxial cable connector comprising the steps of: providing a cylindrical casing having a deformation region located between non-deformable opposed ends of the casing; slidably engaging a barrel with the casing between the casing opposed ends; and, dimensioning the cylindrical casing and the barrel such that portions of a coaxial cable passing between the casing and a core tube are fixed when the deformation region is deformed by movement of the barrel over the deformation region.

DESCRIPTION OF THE PREFERRED EMBODIMENTS

Figure 1A:
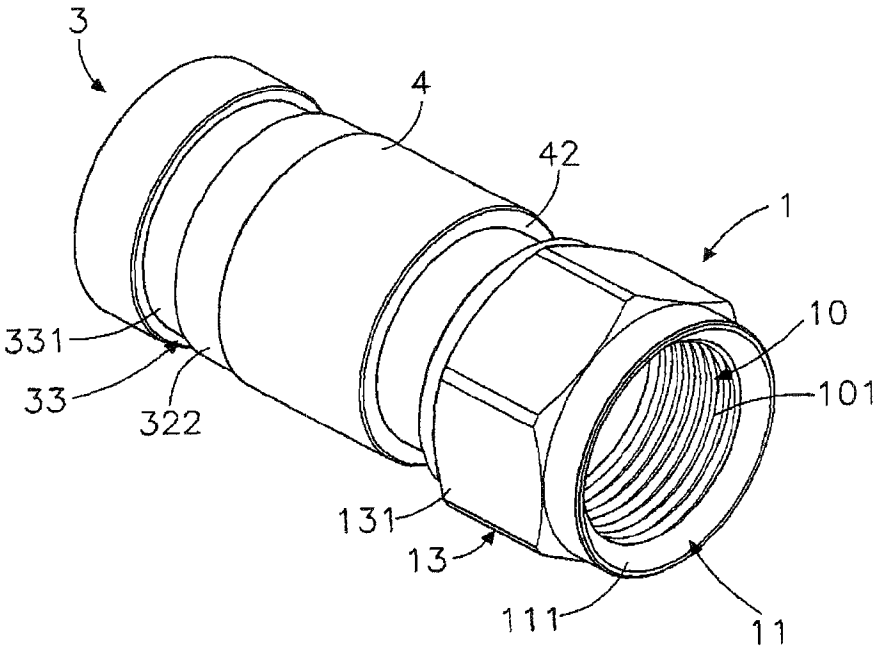
FIGS. 1A-C are perspective views of electrical signal connectors in accordance with the present invention.
Figure 1B:
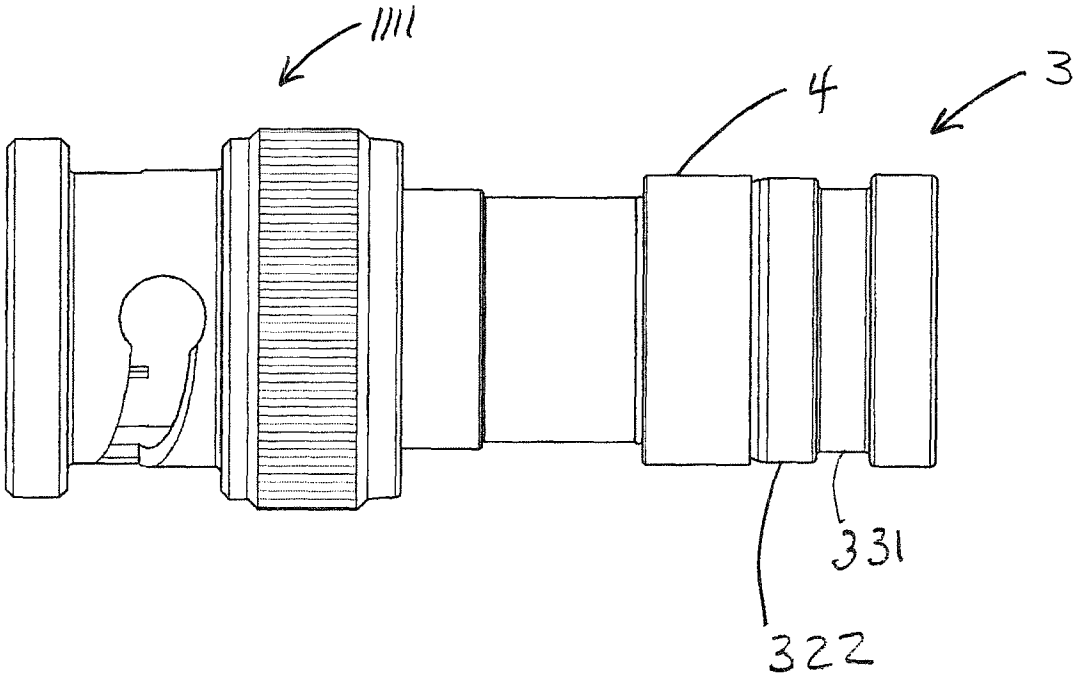
Figure 1C:
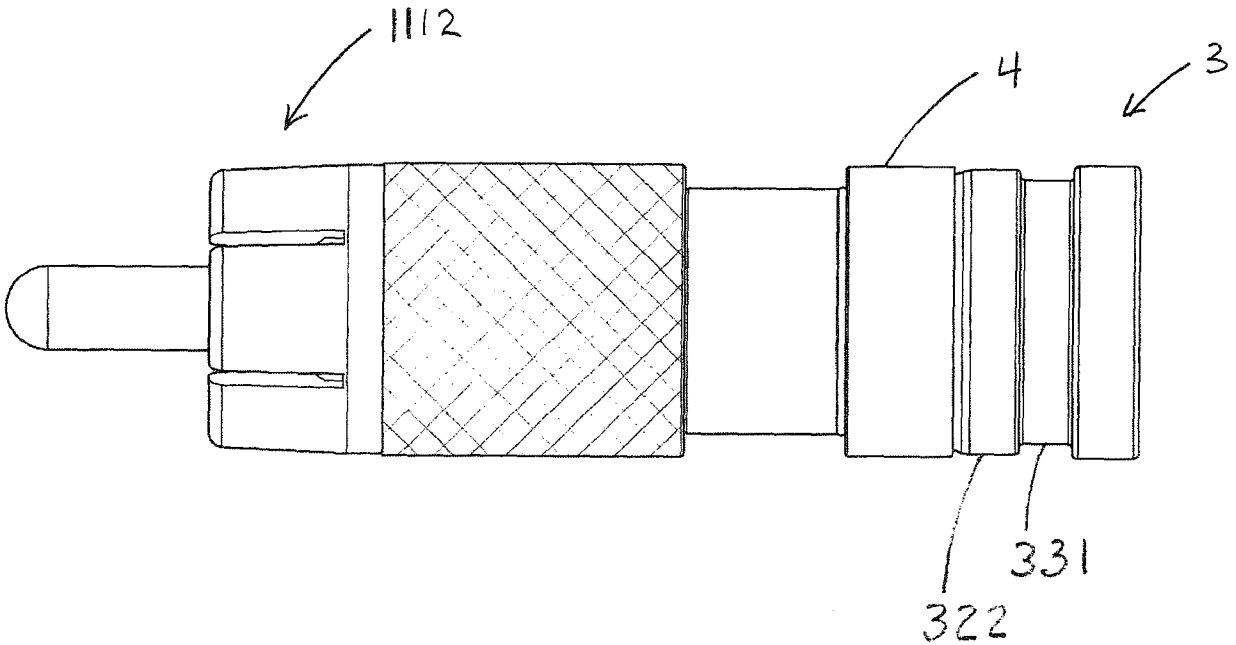

Referring to FIGS. 1A-C, 2, 3, and 4A, embodiments of the electrical signal connector of the present invention are shown. The electrical signal connector comprises a core tube 2, a cylindrical casing 3 and a barrel 4. An optional fastener in the form of an internally threaded locknut 1 is also shown. Variants of this fastener include any of F-Type, BNC, RCA, and other suitable coaxial cable connector fasteners known to persons of ordinary skill in the art. See for example the BNC connector embodiment of FIG. 1B and the RCA connector embodiment of FIG. 1C. Unless otherwise noted, an F-Type connector such as the connector of FIG. 1A is used to illustrate features of the invention. As used herein, cylindrical includes enveloping shapes such as cylinders, polygons, and irregular enveloping shapes. And, as used herein, barrel includes sleeve-like structures such as a barrel having one or more cylindrical inner diameters and one or more cylindrical outer diameters.

The locknut shown 1 is a metal member shaped like a polygonal screw nut with a center hole 10 axially extending through opposing front and rear sides thereof. An inner thread 101 extends around a locknut inside wall and a nearby annular locating flange 11 defines a locknut orifice 111 accessing one end of the center hole 10. A rim-like retaining portion 12 is located on the rear side of the locknut around the center hole 10, and an operating portion 13 is formed of a multi-sided wall such as a hexagonal wall 131 disposed around the center hole 10 between the annular locating flange 11 and the retaining portion 12. The retaining portion 12 comprises an inwardly facing stepped shoulder 121 adjoining a beveled abutment face 122 proximate an interior of the locking nut 199.

A core tube 2 engages the locknut 1 and includes an elongated tube. The core tube 2 comprises an axial hole 20 axially extending through opposing front and rear sides thereof, a stop flange 21 extending around the periphery of the front side thereof, a barbed flange 24 extending around the periphery of the rear side thereof, a first tubular wall 221 and a second tubular wall 23 axially connected in series between the stop flange 21 and the barbed flange 24 around the axial hole 20 in a stepped manner, a packing portion 22 connected between the stop flange 21 and the first tubular wall 221 around the axial hole 20, an outside annular groove 211 located on the periphery between the stop flange 21 and the packing portion 22 and around the axial hole 20, and a gasket ring 212 mounted around the outside annular groove 211.

In various embodiments, the cylindrical casing 3 is made of a suitable deformable material such as deformable metal or plastic suited to the application. The casing comprises a tubular body 312 and one or more deformable portions. An axial hole 30 is surrounded by the tubular body 312 and an annular flange 31 is located near the front end of the tubular body 312 defining a vertical front stop edge 311. A first tubular deformable portion 32 and a second tubular deformable portion 33 are axially connected in series around the axial hole 30 and extend from a rear end of the tubular body 312. A vertical rear stop edge 34 is located on a rear end of the second tubular deformable portion 33 opposite to the first tubular deformable portion 32 and a tapered abutment face 321 is formed of a part of the first tubular deformable portion 32. The tapered abutment face 321 slopes downwardly forwardly from the first tubular deformable portion 32 toward the tubular body 312 and an outside annular flange 322 formed of a part of the first tubular deformable portion 32 is connected between the tapered abutment face 321 and the second tubular deformable portion 33. A locating groove 331 extended around the periphery of the second tubular deformable portion 33.

The barrel 4 comprises a receiving hole 40 axially extending through opposing front and rear sides thereof. In some embodiments a tapered inner surface portion 41 is located on the rear side thereof and has an inner diameter that increases gradually outwardly from the receiving hole 40 toward the rear side of the barrel 4. An annular front stop edge 42 is perpendicularly located on the front side of the barrel 4 around the receiving hole 40.

During installation, insert the core tube 2 through the orifice 111 in the annular locating flange 11 of the locknut 1 into the center hole 10 of the locknut 1 to abut the stop flange 21 of the core tube 2 against the retaining portion 12 of the locknut 1. At this time, the stepped shoulder 121 and the beveled abutment face 122 of the retaining portion 12 of the locknut 1 are forced against the gasket ring 212 at the outside annular groove 211 of the core tube 2. Thus, the locknut 1 effectively prohibits permeation of outside water after installation of the electrical signal connector in a coaxial cable and connection of the electrical signal connector to a signal distributor.

After connection between the locknut 1 and the core tube 2, insert the core tube 2 into the axial hole 30 of the cylindrical casing 3 to press-fit the annular flange 31 of the cylindrical casing 3 onto the first tubular wall 221 of the core tube 2 and to simultaneously stop the vertical front stop edge 311 of the annular flange 31 against the retaining portion 12 of the locknut 1. At this time, the retaining portion 12 of the locknut 1 is positioned in the space between the annular flange 31 of the cylindrical casing 3 and the stop flange 21 of the core tube 2 to prohibit falling of the locknut 1 out of the core tube 2, and the second tubular wall 23 and barbed flange 24 of the core tube 2 suspend in the axial hole 30 of the cylindrical casing 3. Thereafter, attach the barrel 4 to the cylindrical casing 3 to have the tubular body 312 of the cylindrical casing 3 be received in the receiving hole 40 of the barrel 4 and kept in contact with the inside wall 401 of the barrel 4, allowing axial movement of the barrel 4 along the tubular body 312 of the cylindrical casing 3.

Figure 4A:
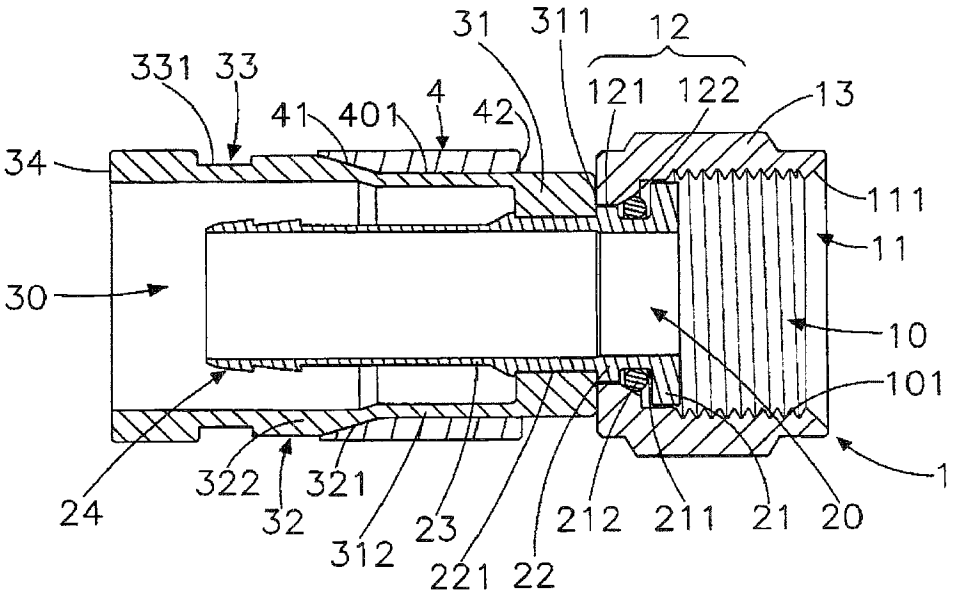
FIGS. 4A-4E are sectional side views of electrical signal connectors in accordance with the present invention.
Figure 4B:
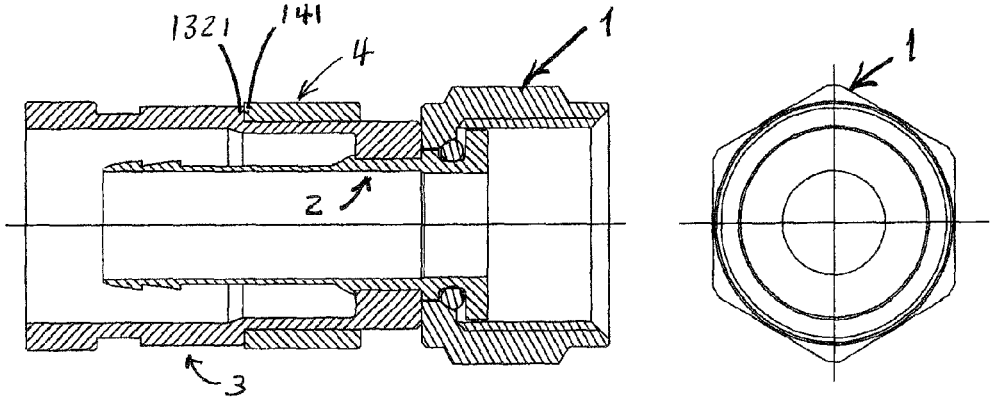
Figure 4C:
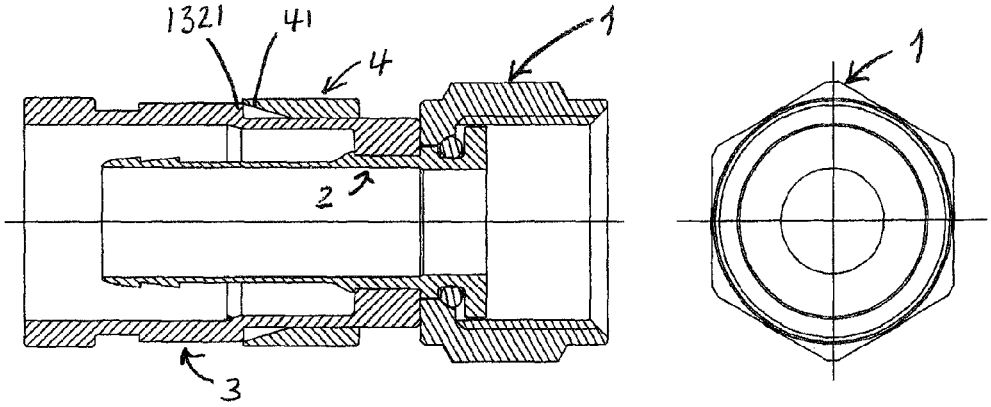
Figure 4D:
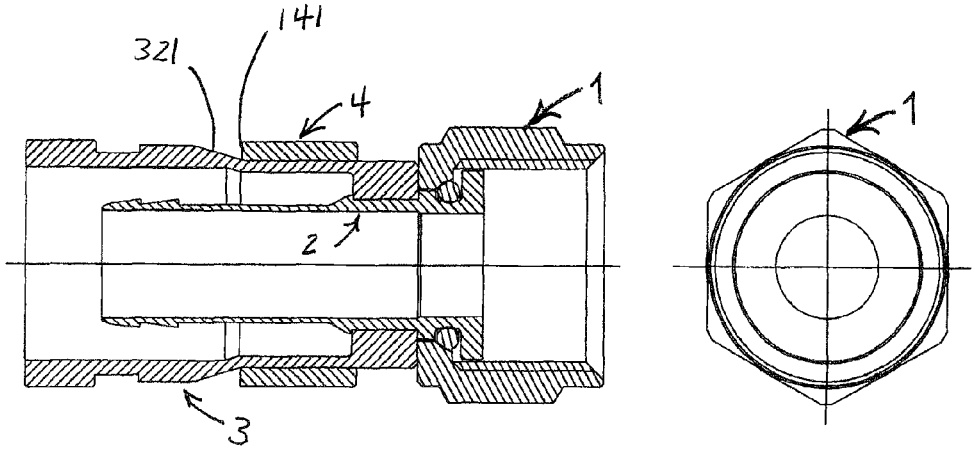

FIGS. 4B-4D illustrate other embodiments of the invention similar to the connector of FIG. 4A. These embodiments have barrels 4 and/or cylindrical casings 3 with differing features. In the FIG. 4B, the barrel has a straight inner surface portion 141 without a taper and the cylindrical casing has a square shoulder 1321 without a taper. In FIG. 4C, the barrel has a tapered inner surface portion 41 and a square shoulder 1321 without a taper. In FIG. 4D, the barrel has a straight inner surface portion 141 without a taper and the cylindrical casing has a tapered abutment face 321.

Figure 4E:
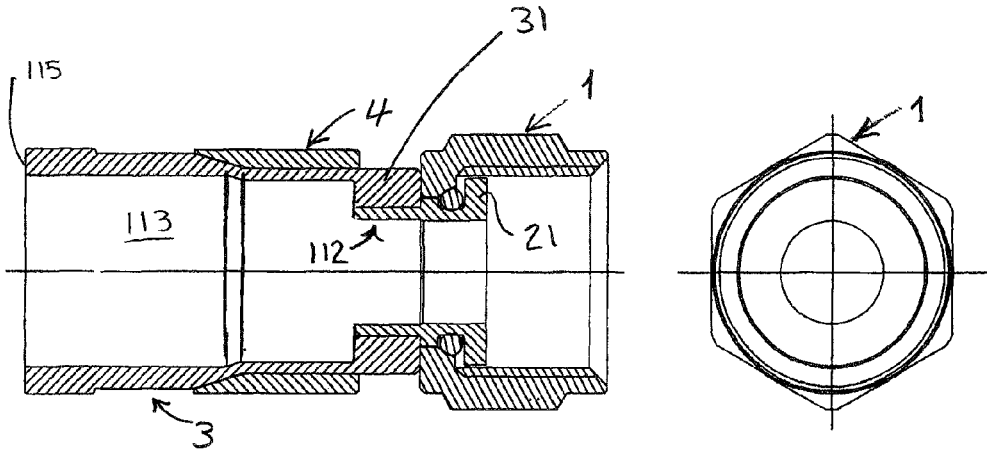

FIG. 4E illustrates another embodiment of the invention similar to the connector of FIG. 4A. This embodiment has a shortened core tube 112 that extends from a core tube stop flange into the cylindrical casing annular flange 31. As seen, a first end of the cylindrical casing 115 adjoins a casing lumen 113 that is for receiving a coaxial cable. In various embodiments, the core tube does not extend into the lumen. In various embodiments, the shortened core tube is fixed to the cylindrical casing annular flange via an interference fit, barbs (not shown), adhesive, melting of a parent material, or by another suitable means known to persons of ordinary skill in the art. When a coaxial cable is inserted in a connector with a shortened core tube, the cable and the connector are fixed together when the cylindrical casing deforms radially inward creating a circumferential compression fit where the casing contacts the outer jacket of the coaxial cable. See for example the text and figures, including FIGS. 2-4 and the related description, found in U.S. Pat. No. 7,112,093 filed Mar. 15, 2005 by inventor Michael Holland which is incorporated herein in its entirety and for all purposes.

Figure 5:
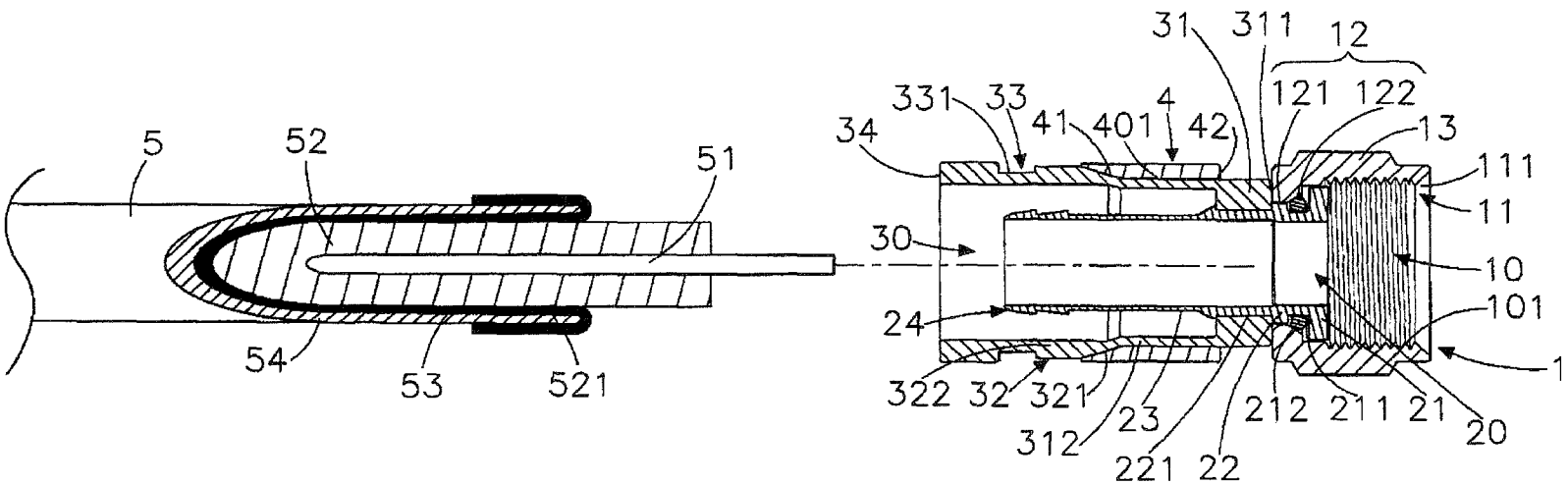
FIG. 5 is a schematic installed view of the present invention, illustrating connection between the electrical signal connector and a coaxial cable (I).
Figure 6:
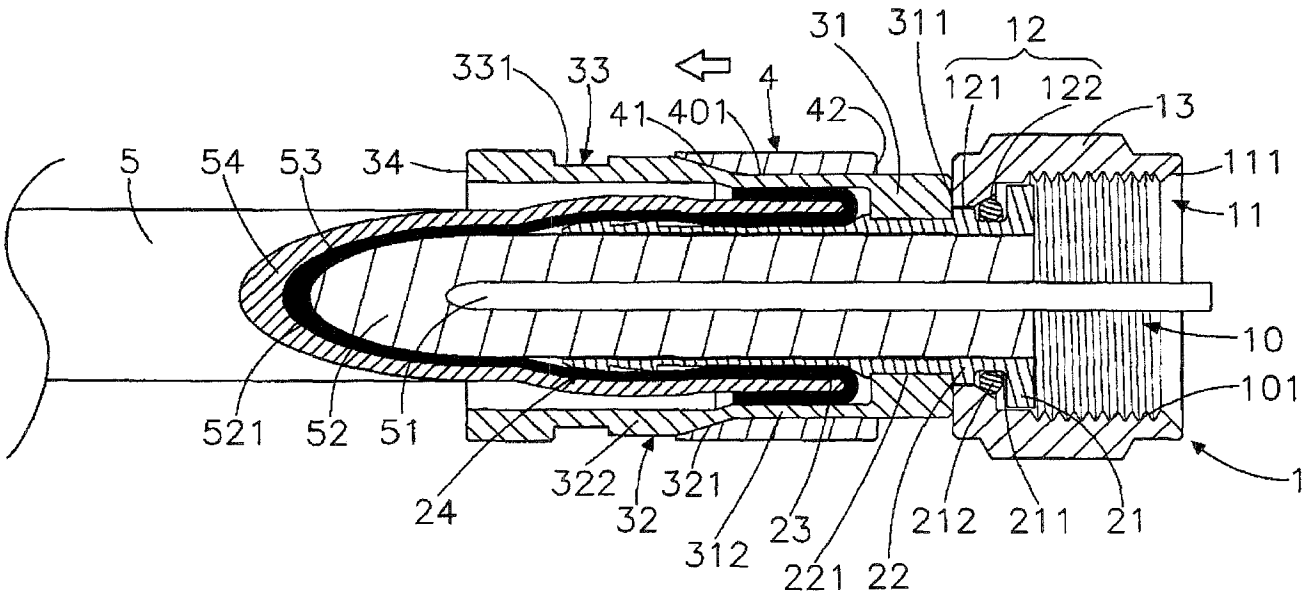
FIG. 6 is a schematic installed view of the present invention, illustrating connection between the electrical signal connector and the coaxial cable (II).
Figure 7:
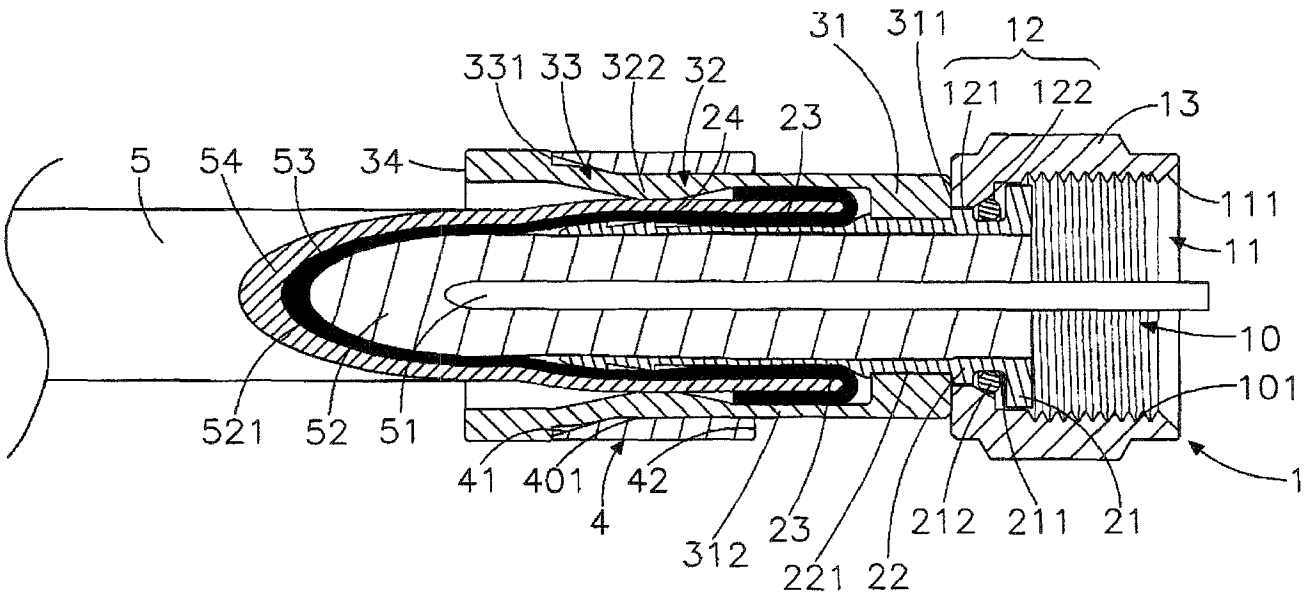
FIG. 7 is a schematic installed view of the present invention, illustrating connection between the electrical signal connector and the coaxial cable (III).

Referring also to FIGS. 5-7, the electrical signal connector of the invention is to be used with a coaxial cable 5 that comprises a dielectric insulator 52 surrounding an electric conductor core (center conductor, for example a metallic or copper center conductor) 51, the dielectric insulator 52 surrounded by a shield (for example, a woven metal wrapper) 53, and the shield surrounded by an outer plastic sheath 54. In some embodiments, a second shield such as an aluminum foil (or mylar tape) shield 521 surrounds the inner dielectric insulator 52.

In various embodiments, the electrical signal connector is fastened to the coaxial cable 5. For example, when fastening the electrical signal connector to the coaxial cable 5, insert the copper core (center conductor) 51, inner dielectric insulator 52 and aluminum foil shield (or mylar tape) 521 (optional as mentioned above) of the coaxial cable 5 into the axial hole 20 of the core tube 2 in the axial hole 30 of the cylindrical casing 3 such that the braided metal wrapper (woven copper shield) 53 and outer plastic sheath 54 of the coaxial cable 5 are sleeved onto the tubular well 23 and barbed flange 24 (optional as mentioned above) of the core tube 2. When pushing the coaxial cable 5 forwardly relative to the electrical signal connector to the position where the end edge of the inner dielectric insulator 52 is near or flush with the front side of the core tube 2, the copper core (center conductor) 51 of the coaxial cable 5 is forced to protrude from the orifice 111 of the annular locating flange 11 of the locknut 1.

When the coaxial cable 5 is properly positioned in the electrical signal connector, a tool can be used to fix the cable and connector together. For example, a hand crimper or an automated machine can be used to perform this fixation where the cylindrical casing 3 is pressed radially inward against the coaxial cable 5.

In some embodiments where a hand crimper is used, two crimping jaws of the hand crimper are respectively attached to the annular flange 31 of the cylindrical casing 3 and a part of the coaxial cable 5 outside the cylindrical casing 3, keeping a part of one crimping jaw stopped against the vertical rear stop edge 34 of the cylindrical casing 3 and a part of the other crimping jaw stopped against the annular front stop edge 42 of the barrel 4.

When the crimping tool is properly positioned, pressure applied to the hand crimper moves the barrel 4 toward the first tubular deformable portion 32 of the cylindrical casing 3 and forces the tapered inner surface portion 41 of the barrel 4 (in embodiments without the taper 41, the inner wall 401) against the tapered abutment face 321 of the cylindrical casing 3.

In some embodiments, as the barrel 4 is sleeved onto the cylindrical casing 3 and kept between the first tubular deformable portion 32 of the cylindrical casing 3 and the locknut 1, moving the barrel 4 toward the first tubular deformable portion 32 of the cylindrical casing 3 does not bias the barrel 4 relative to the cylindrical casing 3, improving alignment accuracy and tending to avoid the use of any extra parts.

When forcing the tapered inner surface portion 41 of the barrel 4 (in embodiments without the taper 41, the inner wall 401) against the tapered abutment face 321 of the cylindrical casing 3 during installation, the outside annular flange or portions thereof 322 is compressed to deform and to squeeze the braided metal wrapper (woven metal shield) 53 and outer plastic sheath 54 of the coaxial cable 5 against the second tubular wall 23 of the core tube 2, causing the core tube wall 23 to be engaged with the braided metal shield (e.g., woven metal wrapper) 53 of the coaxial cable 5.

In some embodiments the outside annular flange 322 and the second tubular deformable portion 33 of the cylindrical casing 3 are evenly compressed to deform and to squeeze the braided metal wrapper (woven metal shield) 53 and outer plastic sheath 54 of the coaxial cable 5 against the second tubular wall 23 and the barbed flange 24 of the core tube 2, causing the barbed flange 24 of the core tube 2 to be engaged into the braided metal shield (e.g., woven metal wrapper) 53 of the coaxial cable 5.

Thus, the coaxial cable 5 and the electrical signal connector are firmly secured together. This installation procedure requires less effort, avoiding damage to the copper core (center conductor) 51 of the coaxial cable 5 or loosening of the coaxial cable 5, and assuring signal transmission stability.

In some embodiments, moving the inside wall 401 of the barrel 4 along the tubular body 312 of the cylindrical casing 3 causes the tapered inner surface portion 41 of the barrel 4 to be moved over the first tubular deformable portion 32 of the cylindrical casing 3 to the locating groove 331 at the second tubular deformable portion 33. This action compresses the first tubular deformable portion 32 and the second tubular deformable portion 33, thereby flattening the first tubular deformable portion 32. Thus, the barrel 4 will be firmly secured to the cylindrical casing 3 when the tapered inner surface portion 41 of the barrel 4 reaches the locating groove 331 of the second tubular deformable portion 33.

Figure 2:
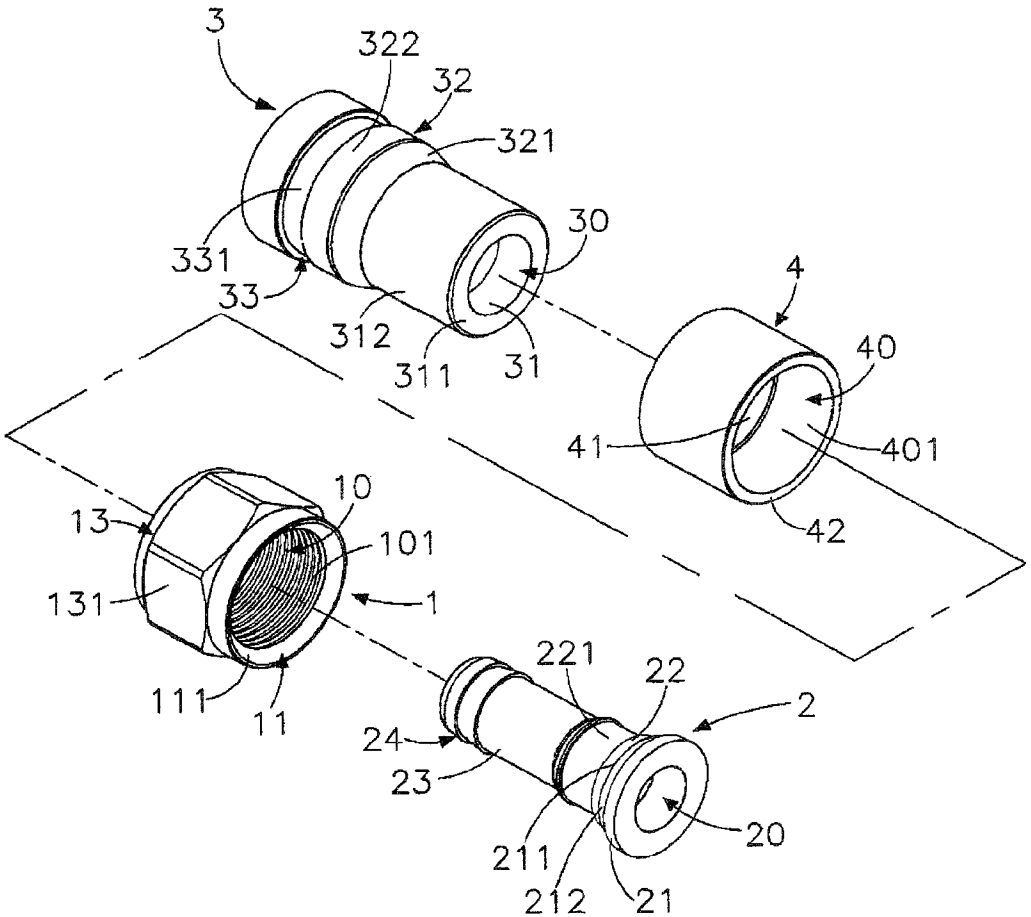
FIG. 2 is an exploded view of a second embodiment of the electrical signal connector in accordance with the present invention.
Figure 3:
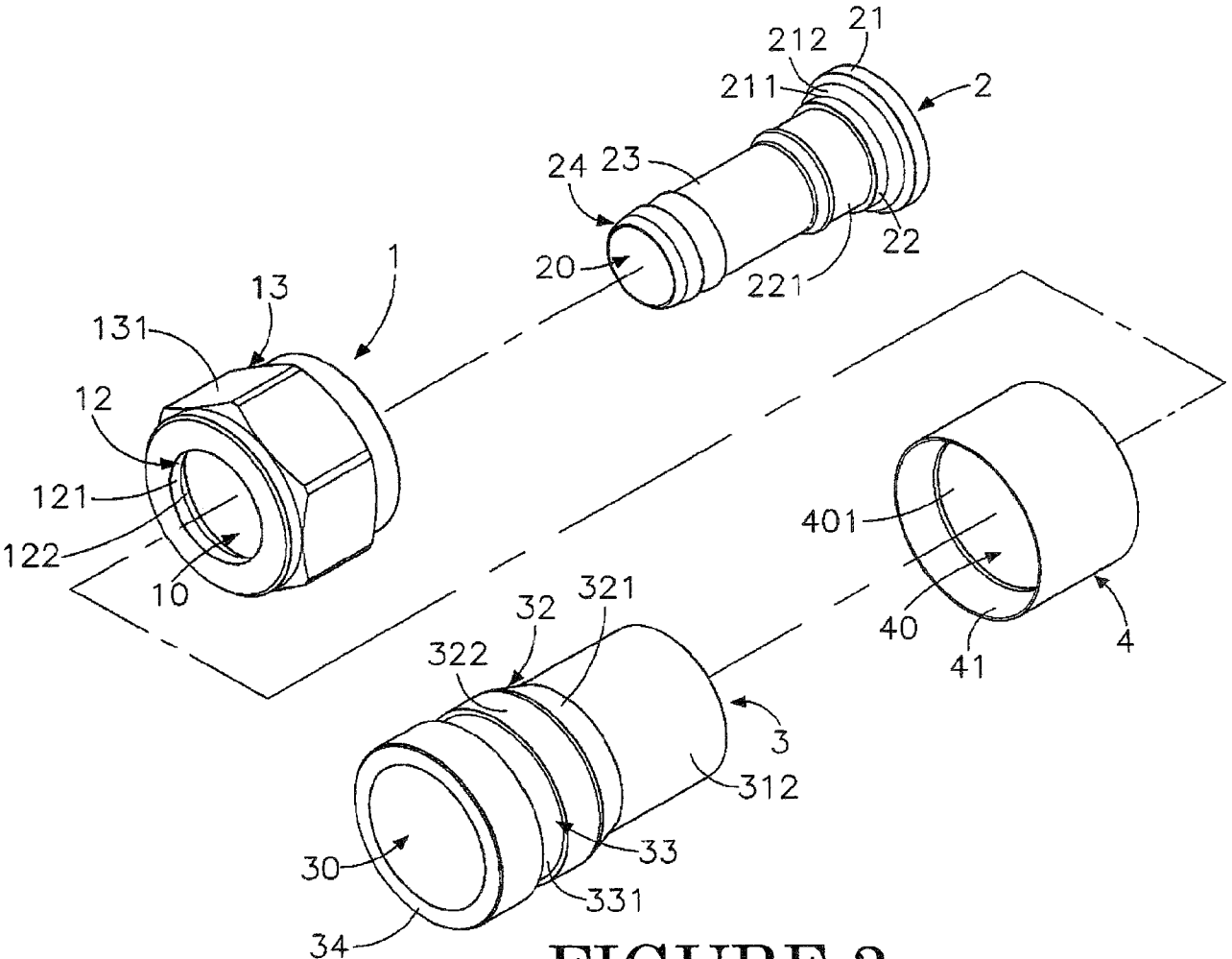
FIG. 3 corresponds to FIG. 2 when viewed from another angle.

Referring again to the embodiments of FIGS. 2 and 5, the stop flange 21 and the packing portion 22 of the core tube 2 are positioned in the rear side of the locknut 1 remote from the annular locating flange 11 and surrounded by the cylindrical casing 3, the second tubular wall 23 and the barbed flange 24 of the core tube 2 suspend in the axial hole 30 of the cylindrical casing 3 for receiving the coaxial cable 5; the barrel 4 is sleeved onto the cylindrical casing 3 with the tapered inner surface portion 41 abutted against the tapered abutment face 321 of the first tubular deformable portion 32. After insertion of the coaxial cable 5 into the core tube 2 and the cylindrical casing 3, the barrel 4 is moved axially relative to the cylindrical casing 3 to force the tapered inner surface portion 41 over the first tubular deformable portion 32 of the cylindrical casing 3 to the locating groove 331 at the second tubular deformable portion 33, thereby compressing the first tubular deformable portion 32 and the second tubular deformable portion 33 and tightening up engagement between the coaxial cable 5 and the core tube 2. Further, the locknut 1 and the core tube 2 can be configured subject to BNC, RCA, IEC, MF90, APL-M or PAL-F specifications.

Figure 8:
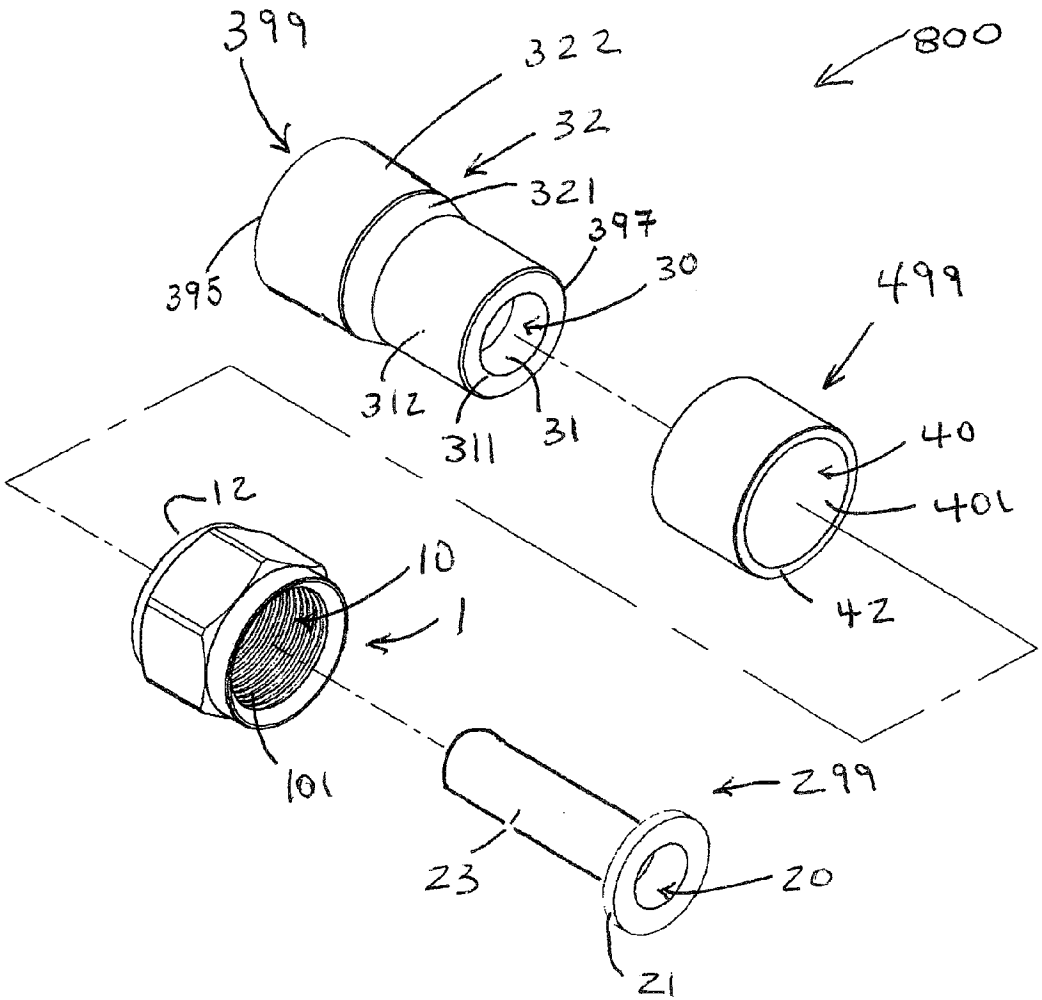
FIG. 8 is an exploded view of another embodiment of the electrical signal connector in accordance with the present invention.

FIG. 8 shows another embodiment of the electrical signal connector of the present invention 800. The electrical signal connector comprises a core tube 299, a cylindrical casing 399 and a barrel 499. An optional fastener in the form of an internally threaded locknut 1 is also shown. Variants of this fastener include any of F-Type, BNC, RCA, and other suitable coaxial cable connector fasteners known to persons of ordinary skill in the art.

The core tube 299 comprises an axial hole 20 axially extending through opposing front and rear sides thereof and a stop flange 21 extending around a periphery of the front side thereof. A tubular wall 23 is coupled to the stop flange. In some embodiments, a barbed flange 24 similar to that of FIG. 2 extends around a periphery of the rear side of the core tube 299. The core tube 299 is made of a suitable rigid, electrically conductive material such as a metal, for example, brass.

The cylindrical casing 399 is made of a suitable deformable material such as a metal, brass for example, or a plastic, Delrin® for example. In some embodiments, elastically deformable plastics such as thermoset elastomers, polyurethane for example, and thermoplastic elastomers, DuPont Alcryn® for example, are used. The casing has a first end 395 for receiving a coaxial cable and a second end 397 for receiving the core tube 299. The casing 399 comprises a tubular body 312, an axial hole 30 surrounded by the tubular body 312, an annular flange 31 located on the front end of the tubular body 312 and defining a vertical front stop edge 311. A tubular deformable portion 32 is coupled to the tubular body 312 around the axial hole 30. A tapered abutment face 321 is formed of a part of the first tubular deformable portion 32 and slopes downwardly forwardly from the tubular deformable portion 32 toward the tubular body 312. In various embodiments, the axial hole 30 diameter is constant and in various embodiments, the axial hole 30 diameter varies.

The barrel 499 is made of a suitable rigid material such as metal, for example brass. The barrel 499 comprises a receiving hole 40 axially extending through opposing front and rear sides thereof and an inside wall 401. In various embodiments, an annular front stop edge 42 is perpendicularly located on the front side thereof around the receiving hole 40. In some embodiments (see FIG. 2) a tapered inner surface portion 41 is located on the rear side thereof and has an inner diameter that increases gradually outwardly from the receiving hole 40 toward a rear side of the barrel.

During assembly of the connector 800, the core tube 20 passes through the locknut 1 such that a locknut retaining portion 12 engages the core tube stop flange 21. The barrel 499 receives the cylindrical casing tubular body 312 therethrough. The core tube tubular wall 23 is inserted through the annular flange of the cylindrical casing 31. In various embodiments, the core tube tubular wall is fixed within the cylindrical casing using one or more of a press fit, core tube barbs (see FIG. 4A), adhesive, weldment, or another suitable means known to persons of ordinary skill in the art.

Attachment of the connector 800 to a coaxial cable is accomplished by moving the barrel 499 toward the cylindrical casing cable entry end 395 such that the cylindrical casing 399 is deformed inwardly and pinches portions of a coaxial cable between the core tube 299 and the cylindrical casing. In various embodiments, tools and methods similar to those described above are used during the connector installation process.

Figure 9:
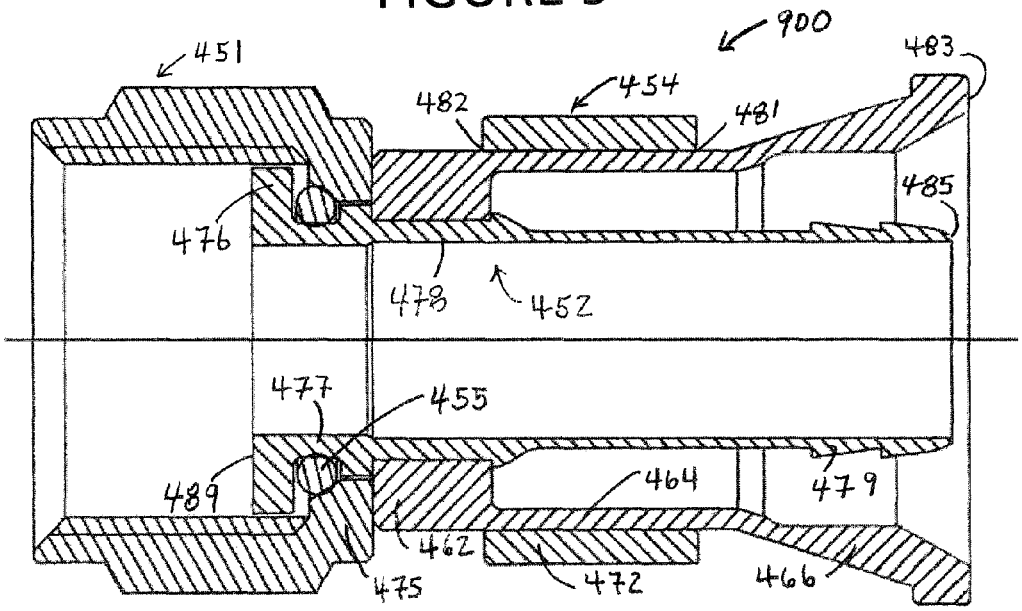
FIGS. 9 and 10 are sectional side views of yet another embodiment of the electrical signal connector in accordance with the present invention.
Figure 10:
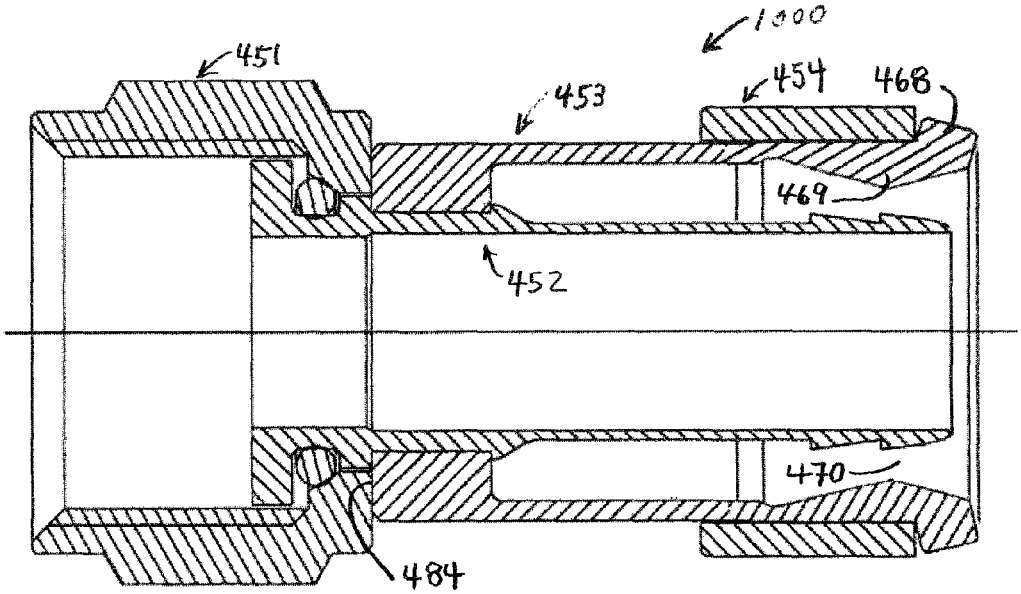
Figure 11:
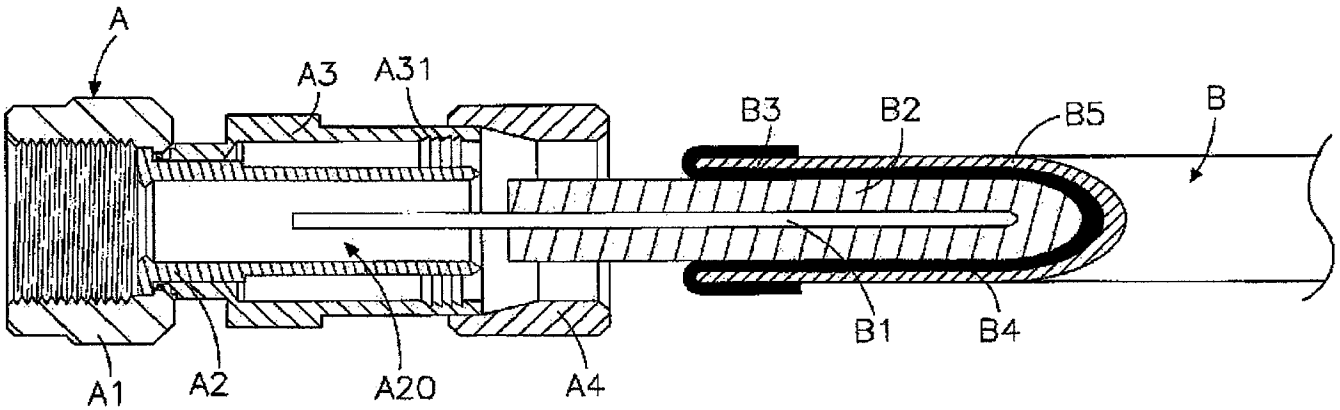
PRIOR ART FIGURE 11
FIGS. 11 and 12 are sectional side views of a prior art electrical signal connector.
Figure 12:
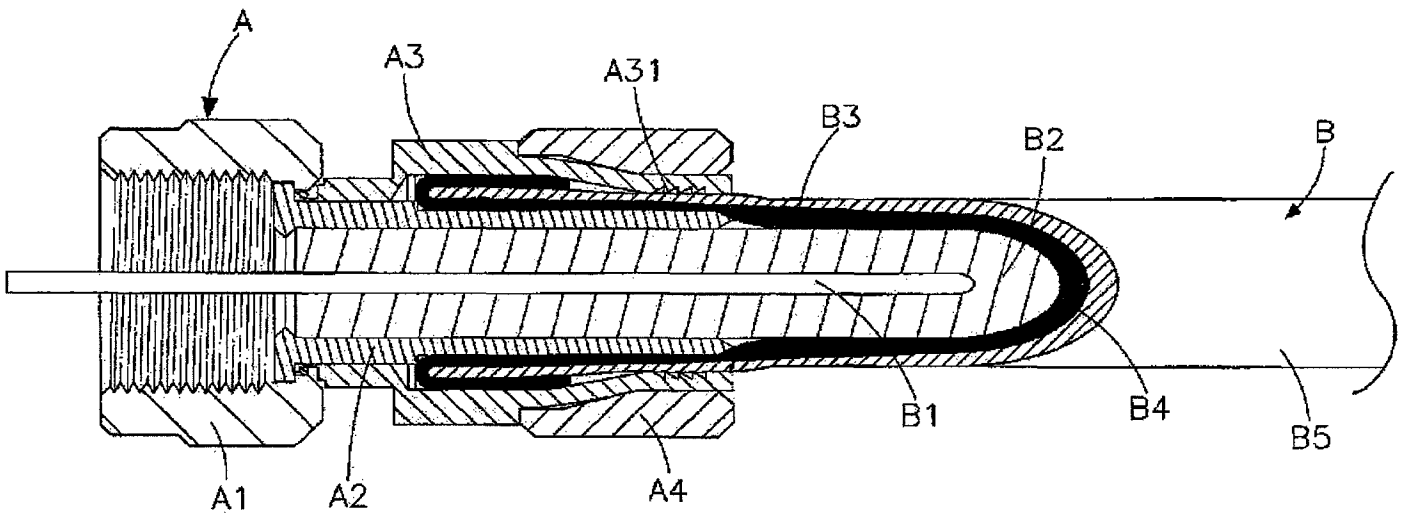
PRIOR ART FIGURE 12

FIGS. 9 and 10 show yet another embodiment of the connector of the present invention 900, 1000. The connector includes a cylindrical casing 453 with a first end 483 for receiving a coaxial cable and a second end 484 for receiving a core tube 452. The core tube has a first end 485 for insertion in a coaxial cable and a generally opposed second end 489.

An optional fastener 451 is coupled to the cylindrical casing and in some embodiments the coupling is implemented with a stop flange 476 of the core tube. In various embodiments with fasteners, the fastener is adapted for use with known coaxial cable connectors including F-Type, BNC, RCA connectors and connectors made to any of F-Type, BNC, RCA, IEC, MF90, APL-M, and PAL-F specifications.

In some embodiments a gasket ring 455 and related sealing structures are included. For example, the gasket ring encircles a core tube gasket seat 477 and seals between the seat and an inwardly facing locknut rim 475. And, in some embodiments, the core tube has a barbed flange 479 near its first end 485. In various embodiments a fitment between the core tube 452 and the cylindrical casing 453 is provided such as an annular flange 462 at or near the casing's second end into which a first tubular wall of the core tube 478 is inserted.

In a first configuration before a coaxial cable is fixed to the connector 900, the cylindrical casing 453 extends through a barrel 454 having first 481 and second 482 open ends. In various embodiments, the cylindrical casing and the barrel are dimensioned such that the barrel is operative to press and deform the cylindrical casing when the barrel is moved from its position in the first configuration 472 toward the cylindrical casing first end 483. The deformation is operative to pinch portions of a coaxial cable located between the cylindrical casing and the core tube (the coaxial cable is not shown in FIGS. 9, 10 for clarity).

In various embodiments, the coaxial cable connector cylindrical casing 543 includes a terminal section or trailing jaw that is flared outwardly 466. This terminal section includes the first end of the cylindrical casing 403. In some embodiments an inward projection or jaw projection of the terminal section 469 provides at least a part of a pincer for use in pinching portions of a coaxial cable such as a coaxial cable outer jacket and shield. And, in some embodiments a peripheral shoulder of the terminal section 468 provides a barrel stop useful for retaining the barrel on the cylindrical casing.

In some embodiments, the cylindrical casing 452 includes a tubular body section 464 between the annular flange 462 and the terminal section 466. And, in some embodiments, the tubular body section extends through the barrel in the first configuration as shown in FIG. 9.

The connector of FIGS. 9 and 10 is made from metal(s) and/or polymer(s). For example, any of the materials discussed herein might be used. In an embodiment, the connector cylindrical casing 453 is made from a deformable plastic while brass is included in one or both of the core tube 452 and the fastener 451.

In one embodiment, assembly of the connector 900, 1000 includes passing the core tube 452 through a fastener 451 such that the locknut is retained by a core tube stop flange 476. The barrel 454 receives the cylindrical casing tubular body 464 therethrough. The core tube is inserted through the annular flange of the cylindrical casing 462. In various embodiments, the core tube tubular wall is fixed within the cylindrical casing using one or more of a press fit, core tube barbs, adhesive, weldment, or another suitable means known to persons of ordinary skill in the art.

Attachment of the connector 900, 1000 to a coaxial cable is accomplished by moving the barrel 454 toward the cylindrical casing first end 483 such that the cylindrical casing 453 is deformed inwardly and pinches portions of a coaxial cable between the core tube 452 and the cylindrical casing. In various embodiments, tools and methods similar to those described above are used during the connector installation process.

Barrel and cylindrical casing features differ in various embodiments of the invention. It is noted that the connectors of FIGS. 8-10, like the connector of FIG. 4A have, in similar embodiments, differing barrel and cylindrical casing features. In particular, as shown in FIGS. 4A-4D, the barrel includes a taper in some embodiments ant the cylindrical casing includes a taper in some embodiments.

Core tube features differ in various embodiments of the invention. It is noted that the connectors of FIGS. 8-10, like the connector of FIG. 4A, have, in similar embodiments, different core tube features. In particular, as shown in FIG. 4E, the core tube is in a shortened core tube 112.

Connector types and their fasteners differ in various embodiments of the invention; indeed, fasteners are optional. It is noted that the connectors herein generally appear with optional fasteners. To the extent suited to a particular connector embodiment, related connector embodiments include any of BNC, RCA, IEC, MF90, APL-M and PAL-F type connectors.

Although particular embodiments of the invention have been described in varying detail for purposes of illustration, modifications and enhancements may be made without departing from the spirit and scope of the invention. Accordingly, the invention is not to be limited except as provided by the appended claims.

What the invention claimed is:

1. A coaxial cable connector comprising:

a cylindrical casing has a first end for receiving a coaxial cable and a second end that receives a core tube;

the core tube engages a first fastener operable to fasten the connector to a mating second fastener;

a barrel has first and second open ends;

in a first configuration before a coaxial cable is fixed to the connector, the casing extends through the barrel;

the casing and the barrel are dimensioned such that the barrel is operative to radially press and radially deform the casing when the barrel is moved from its position in the first configuration toward the casing first end; and, the deformed casing is operative to pinch portions of a coaxial cable located between the cylindrical casing and the core tube.

2. The coaxial cable connector of claim 1 further comprising:

a central casing section having a tapered abutment face; and, the barrel operable in concert with the tapered abutment face to cause casing radial deformation.

3. The coaxial cable connector of claim 2 further comprising:

first and second casing sections having first and second wall thicknesses;

the first wall thickness being greater than the second wall thickness;

the central casing section located between the first and second cylindrical casing sections; and, the casing deformation including deformation of the first casing section and excluding deformation of the second casing section.

4. The coaxial cable connector of claim 2 further comprising a barrel wall taper for coacting with the casing tapered abutment face.

5. The coaxial cable connector of claim 2 wherein the casing is made of a deformable plastic material.

6. The coaxial cable connector of claim 2 wherein the casing is made of a deformable plastic material selected from the group consisting of thermoset elastomers and thermoplastic elastomers.

7. A coaxial cable connector comprising:

a cylindrical casing has a first end for receiving a coaxial cable and a second end receiving a core tube;

the core tube is coupled to a fastener;

a barrel is located in an initial position between the first and second ends of the cylindrical casing;

the barrel slidably engages the cylindrical casing;

movement of the barrel from the initial position toward the cylindrical casing first end is operable to radially compress a deformable portion of the cylindrical casing; and, the deformed cylindrical casing is operable to fix portions of a coaxial cable passing between the cylindrical casing and the core tube.

8. The coaxial cable connector or claim 7 wherein the casing includes a tapered abutment face operable to coact with the barrel.

9. A method of making a coaxial cable connector comprising the steps of:

providing a cylindrical casing having a deformation region located between non-deformable opposed ends of the casing;

slidably engaging a barrel with the casing between the casing opposed ends; and, dimensioning the casing and the barrel such that movement of the barrel over the deformation region is operable to fix portions of a coaxial cable passing between the casing and a core tube.

10. The method of claim 9 wherein the opposed ends include a cable entry end and barrel movement fixing the cable is barrel movement toward the cable entry end.

11. The method of claim 10 wherein the deformation region includes an outside annular flange located between a tapered abutment face and a locating groove.

12. The method of claim 11 wherein barrel movement toward the cable entry end is operative to deform the tapered abutment face, the outside annular flange and the locating groove.

13. A coaxial cable connector comprising:

a fastener is operable to couple the connector with a mating fastener;

a cylindrical casing has a first end for receiving a coaxial cable and a second end for receiving a core tube;

in a first configuration before a coaxial cable is fixed to the connector, the casing extends through a barrel having first and second open ends;

the casing and the barrel are dimensioned such that the barrel is operative to press and deform the casing when the barrel is moved from its position in the first configuration toward the casing first end; and, the deformed casing is operative to pinch portions of a coaxial cable located between the casing and the core tube.

14. The coaxial cable connector of claim 13 wherein a terminal section of the casing includes the first end and is flared outwardly.

15. The coaxial cable connector of claim 14 wherein an inward projection of the terminal section provides a pincer for use in pinching portions of the coaxial cable.

16. The coaxial cable connector of claim 15 wherein a peripheral shoulder of the terminal section provides a barrel stop.

17. A method of making a coaxial cable connector comprising the steps of:

providing a cylindrical casing having a deformation region located between opposed ends of the casing;

slidably engaging a barrel with the casing between the casing opposed ends; and, dimensioning the casing and the barrel such that portions of a coaxial cable passing between the casing and a core tube are fixed therebetween when the deformation region is deformed by movement of the barrel over the deformation region.

18. The method of claim 17 wherein the opposed ends include a cable entry end and barrel movement fixing the cable is barrel movement toward the cable entry end.

19. The method of claim 18 wherein a terminal section of the casing in the deformation region includes the casing first end and is flared outwardly.

20. The method of claim 19 wherein a peripheral shoulder of the terminal section is operable to stop barrel movement toward the cable entry end.

21. The method of claim 20 wherein a barrel wall taper coacts with the terminal section during deformation of the deformation region.

22. A coaxial cable connector comprising:

a cylindrical casing has a first end and a second end;

a lumen adjoins the first end and is for receiving a coaxial cable;

a shortened core tube is received by the second end but not by the lumen;

the shortened core tube engages a first fastener operable to fasten the connector to a mating second fastener;

in a first configuration before a coaxial cable is fixed to the connector, the casing extends through a barrel having first and second open ends;

the casing and the barrel are dimensioned such that the barrel is operative to radially press and radially deform the casing when the barrel is moved from its position in the first configuration toward the casing first end; and, the deformed casing is operative to circumferentially press against an outer jacket of the coaxial cable to fix the connector to the cable.

23. A coaxial cable connector comprising:

a locknut including opposing front and rear sides;

a core tube, said core tube comprising an axial hole axially extending through opposing front and rear sides thereof for receiving a center conductor, an inner dielectric insulator and a shield of a coaxial cable, and a first tubular wall and a second tubular wall axially connected in series around the axial hole of said core tube for supporting a metal wrapper and an outer plastic sheath of said coaxial cable;

a cylindrical casing surrounding said core tube, said cylindrical casing being deformable, said cylindrical casing comprising an axial hole for receiving said core tube, a first tubular deformable portion and a second tubular deformable portion axially connected in series around the axial hole of said cylindrical casing; and, a barrel axially movably mounted on said cylindrical casing between said first tubular deformable portion and said locknut, said barrel movable over said first tubular deformable portion and said second tubular deformable portion of said cylindrical casing for compressing said first tubular deformable portion and said second tubular deformable portion against an inserted coaxial cable and said core tube.

* * * * *